US011697974B2

(12) United States Patent
Al-Mousa et al.

(10) Patent No.: US 11,697,974 B2
(45) Date of Patent: Jul. 11, 2023

(54) WELLBORE LOGGING

(71) Applicant: Saudi Arabian Oil Company, Dhahran (SA)

(72) Inventors: Ahmed Al-Mousa, Dhahran (SA); Omar M. Alhamid, Dammam (SA); Mohammed Ahmed Alkhowaildi, Safwa (SA)

(73) Assignee: Saudi Arabian Oil Company, Dhahran (SA)

( * ) Notice: Subject to any disclaimer, the term of this patent is extended or adjusted under 35 U.S.C. 154(b) by 17 days.

(21) Appl. No.: 17/374,505

(22) Filed: Jul. 13, 2021

(65) Prior Publication Data

US 2023/0015244 A1 Jan. 19, 2023

(51) Int. Cl.

| | |
|---|---|
| ***E21B 23/14*** | (2006.01) |
| ***E21B 23/01*** | (2006.01) |
| ***E21B 47/01*** | (2012.01) |
| ***E21B 47/13*** | (2012.01) |
| ***E21B 33/129*** | (2006.01) |

(52) U.S. Cl.

CPC ..... *E21B 23/14* (2013.01); *E21B 23/01* (2013.01); *E21B 33/129* (2013.01); *E21B 47/01* (2013.01); *E21B 47/13* (2020.05)

(58) Field of Classification Search

CPC ..... E21B 23/14; E21B 23/08; E21B 23/01; E21B 33/129; E21B 47/01; E21B 47/13

See application file for complete search history.

(56) References Cited

U.S. PATENT DOCUMENTS

| | | | | |
|---|---|---|---|---|
| 9,010,427 | B2 * | 4/2015 | Macrae | E21B 47/26 166/301 |
| 9,441,451 | B2 | 9/2016 | Jurgensmeier | |
| 9,528,354 | B2 | 12/2016 | Loiseau et al. | |
| 9,617,829 | B2 | 4/2017 | Dale et al. | |
| 11,346,170 | B2 * | 5/2022 | Alsahlawi | E21B 23/0413 |
| 2005/0241835 | A1 * | 11/2005 | Burris, II | E21B 23/00 166/313 |
| 2008/0007421 | A1 | 1/2008 | Liu et al. | |
| 2009/0266544 | A1 * | 10/2009 | Redlinger | E21B 29/005 166/298 |
| 2014/0166277 | A1 * | 6/2014 | Ade-Fosudo | E21B 47/06 166/66.4 |
| 2017/0130575 | A1 * | 5/2017 | Jaffrey | E21B 33/0355 |
| 2017/0350237 | A1 * | 12/2017 | Giem | E21B 23/01 |

* cited by examiner

*Primary Examiner* — Caroline N Butcher
(74) *Attorney, Agent, or Firm* — Fish & Richardson P.C.

(57) ABSTRACT

A wellbore assembly includes a cable and a wellbore tool. The wellbore tool is coupled to the downhole end of the cable. The wellbore tool includes a housing, one or more sensors, a packer, and a controller. The one or more sensors are coupled to the housing or to the cable or both. The sensors detect one or more parameters of the wellbore tool or the cable or both. The controller is coupled to the housing. The controller is electrically coupled to one or more sensors and is operationally coupled to the packer. The controller determines, with the wellbore tool parted from the cable and based on information received from the one or more sensors, an indication of the wellbore tool in free fall. The controller activates, based on the determination, the packer to expand the packer and set the wellbore tool on a wall of the wellbore.

17 Claims, 4 Drawing Sheets

WELLBORE LOGGING

FIELD OF THE DISCLOSURE

This disclosure relates to wellbores, in particular, to wellbore logging tools.

BACKGROUND OF THE DISCLOSURE

During logging or other rigless operations, wellbore equipment is lowered within a wellbore by a cable. Wellbore logging is used to make detailed records of geologic formations and other parameters of a wellbore. Logging tools can send the detected information to a surface of the wellbore or can save the information in a local memory that is accessed once the logging tool is brought back to the surface. Methods and equipment for improving wellbore logging operations are sought.

SUMMARY

Implementations of the present disclosure include a wellbore assembly that includes a cable and a wellbore tool. The cable is disposed within a wellbore and extends from or near a surface of the wellbore to a downhole end of the cable. The wellbore tool is coupled to the downhole end of the cable and is suspended on the cable. The wellbore tool includes a housing, one or more sensors, a packer, and a controller. The housing is coupled to the cable. The one or more sensors are coupled to the housing or to the cable or both. The sensors detect one or more parameters of the wellbore tool or the cable or both. The controller is coupled to the housing. The controller is electrically coupled to one or more sensors and is operationally coupled to the packer. The controller determines, with the wellbore tool parted from the cable and based on information received from the one or more sensors, an indication of the wellbore tool in free fall. The controller activates, based on the determination, the packer to expand the packer and set the wellbore tool on a wall of the wellbore.

In some implementations, the one or more parameters includes at least one of an acceleration of the wellbore tool, an angular velocity of the wellbore tool, a tilt angle of the wellbore tool, or a tension of the cable. In some implementations, the one or more sensors includes at least one of an accelerometer, a gyroscope, a tilt sensor, or a tension sensor. The accelerometer is coupled to the housing. The accelerometer detects an acceleration of the wellbore tool. The gyroscope is coupled to the housing and detects an angular velocity of the wellbore tool. The tilt senor is coupled to the housing and detects an angle of inclination of the wellbore tool. The tension senor is coupled to the cable adjacent the wellbore tool and detects a tension of the cable. In some implementations, the controller compares the one or more parameters to respective thresholds and activates, based on a determination that the one or more parameters satisfies the respective thresholds, the packer. In some implementations, the controller activates the packer upon determining that the tension of the cable is zero. In some implementations, the controller compares the acceleration of the wellbore tool to an acceleration threshold and determines, based on the comparison, that the acceleration of the wellbore tool satisfies the acceleration threshold. The controller activates, based on the determination that the acceleration of the wellbore tool satisfies the acceleration threshold and based on a determination that the tension of the cable is zero, the packer.

In some implementations, the wellbore tool further includes a transmitter coupled to the housing and communicatively coupled to the controller. The transmitter receives from the controller and transmits, to a receiver at or near a surface of the wellbore, location information of the wellbore tool.

In some implementations, the packer includes a length that is greater than 15% of a length of the wellbore tool such that the packer substantially centers the wellbore tool with respect to a central longitudinal axis of the wellbore. In some implementations, the one or more sensors detect and transmit, to the controller, packer information. The controller determines, based on the packer information, at least one of a condition of the packer and a seal integrity of the packer.

In some implementations, the packer includes an electrically-activable packer. The electrically-activable packer including an inflatable rubber element that extends, upon activation by the controller, radially from the wellbore tool to a wall of the wellbore.

In some implementations, the wellbore tool includes a logging tool. The logging tool including one or more batteries that power at least one of the controller or the one or more sensors. In some implementations, the wellbore tool further includes a memory coupled to the housing and communicatively coupled to the controller, the memory can store wellbore logging data and instructions that are executable by the controller.

Implementations of the present disclosure include a wellbore tool that includes a housing, one or more sensors, an anchor assembly, and a controller. The housing is coupled to a cable disposed within a wellbore. The one or more sensors are coupled to the housing or the cable or both and detects one or more parameters of the wellbore tool or the cable or both. The controller is coupled to the housing. The controller is electrically coupled to the sensor and operationally coupled to the anchor assembly. The controller determines, based on information received from the sensor, that the tool is falling. The controller activates, based on the determination, the anchor assembly to anchor the wellbore tool on a wall of the wellbore.

In some implementations, the controller determines in or near real time the indication of the wellbore tool in free fall and activate the anchor assembly.

In some implementations, the controller compares two parameters of the wellbore tool to two respective thresholds and activates the anchor assembly upon determining that both thresholds have been met.

In some implementations, the one or two parameters includes an acceleration of the wellbore tool. The controller activates the anchor assembly upon determining that the acceleration of the wellbore tool is equal to or greater than an acceleration threshold that indicates that the wellbore tool is in free fall.

Implementations of the present disclosure also include a method that includes receiving, by a controller coupled to a logging tool suspended on a cable disposed within a wellbore, 1) one or more parameters of the wellbore and 2) one or more parameters of the logging tool or the cable or both. The method also includes comparing, by the controller, the one or more parameters of the logging tool or the cable or both to a threshold. The threshold includes a parameter that indicates that the logging tool is in free fall. The method also includes determining, by the controller, that the one or more parameters of the logging tool or the cable or both satisfy the threshold. The method also includes activating, based on the determination that the one or more parameters of the logging tool or the cable or both satisfy the threshold, a packer of the logging tool. The activated packer secures the logging tool to a wall of the wellbore.

In some implementations, the method also includes transmitting, by the controller and to a transmitter of the logging tool, location information of the logging tool. The transmitter wirelessly transmits the location information to a receiver at or near a surface of the wellbore.

In some implementations, the one or more parameters of the logging tool or the cable or both includes an acceleration of the logging tool. Comparing the one or more parameters of the logging tool or the cable or both includes comparing the acceleration of the wellbore tool to an acceleration threshold indicating that the logging tool is in free fall. In some implementations, the one or more parameters of the logging tool or the cable or both includes a tension of the cable. The method further includes, before activating the packer, determining that the tension of the cable is zero.

DETAILED DESCRIPTION OF THE DISCLOSURE

The present disclosure describes a wellbore tool with an inflatable free fall packer. The wellbore tool is suspended at the end of a wireline or slick line. The wireline can break off or otherwise disconnect from the wellbore tool due to differential pressures in the wellbore, equipment failure, stuck equipment, and other related reasons. Recovering a parted logging tool can be costly. To recover parted or stuck equipment, a fishing operation can be performed. Equipment that has fallen to a deep downhole location can be difficult to retrieve.

The wellbore tool includes one or more sensors that detect when the wellbore tool is falling after being disconnected from the wireline. The sensor is communicatively coupled to a controller. The controller activates the inflatable packer based on information received from the sensor. When the sensor detects that the wireline tool has begun falling, the sensor sends information to the controller, and the controller triggers the inflatable packer. The controller can also activate the packer based on detecting that the tension of the cable is zero or near zero. The packer retains the wellbore tool within the wellbore and prevents the wellbore tool from falling deeper into the wellbore. The packer inflates to retain the tool and center the tool within the wellbore. The tool has a wireless transmitter to communicate the location of the tool to a receiver at the surface of the wellbore.

Particular implementations of the subject matter described in this specification can be implemented so as to realize one or more of the following advantages. For example, the packer of the wellbore assembly can prevent the wellbore tool from falling deep into the wellbore away from the cable, which can save time and resources during a fishing operation. Additionally, the packer can center the wellbore tool, which allows a fishing tool to quickly engage the wellbore tool. Additionally, the packer can help isolate the wellbore (e.g., an open hole section of the wellbore) temporary until the tool is recovered.

Figure 1:
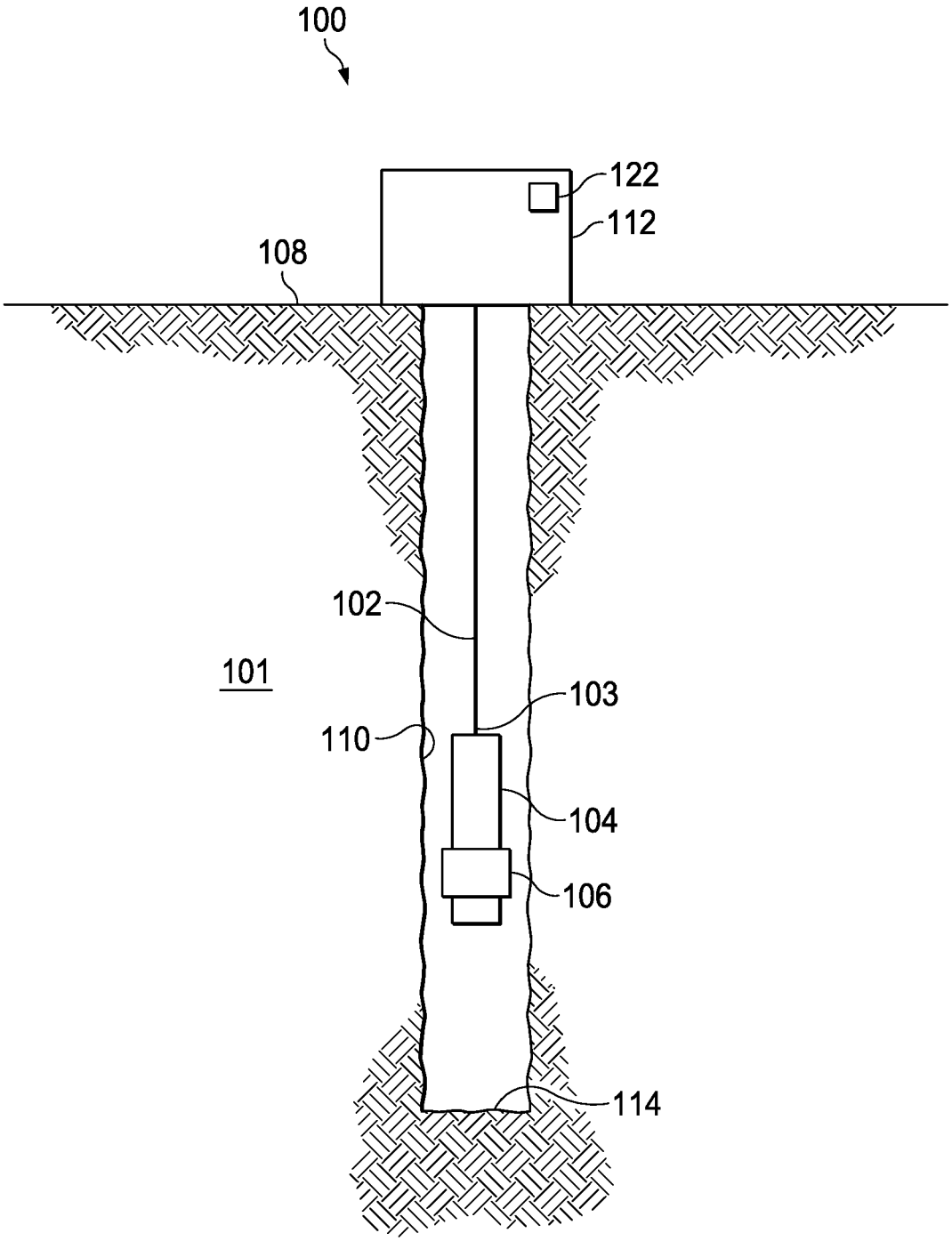
FIG. 1 is a front schematic view, partially cross sectional, of a wellbore assembly according to implementations of the present disclosure.

FIG. 1 shows a wellbore assembly 100 that includes a cable 102 disposed within a wellbore 110 and wellbore tool 104 (e.g., a logging tool, measuring equipment, or another type of downhole tool) coupled to a downhole end 103 of the cable 102. The wellbore 110 can be formed in a geologic formation 101. The geologic formation 101 can include a hydrocarbon reservoir from which hydrocarbons can be extracted. The wellbore extends from a surface 108 (e.g., a ground surface) to a downhole end 114 of the wellbore 110. The wellbore tool 104 can be lowered into the wellbore 110 during any phase of a wellbore's history such as during drilling, completing, producing, or abandoning the well.

The cable 102 can be or include, for example, a wireline or a slickline. The cable 102 extends from or near the surface 108 of the wellbore 110 to the downhole end 103 of the cable 102. The cable 102 can be attached to a surface equipment 112 at or near the surface 108. (e.g., a crane or a logging truck) that includes a cable drum that winds and unwinds the cable 102 to lower or pick up the wellbore tool 104. As further described below with respect to FIG. 3, the wellbore tool 104 has a packer 106 (e.g., a mechanical inflatable packer or another type of anchor assembly) that can prevent, in the event that the wellbore tool 104 parts from the cable 102, the wellbore tool 104 from falling deep into the wellbore 110 or from reaching the downhole end 114 of the wellbore 110. The wellbore assembly 100 can also include a receiver 122 or a transceiver that sends and receives information to and from the wellbore tool 104. The wellbore tool 104 is suspended on the cable 102 such that the cable is under tension when the tool 104 is attached to the cable 102 and the tool 104 moves at the same speed as the end 103 of the cable 102 as the cable 102 is lowered or retrieved to and from the wellbore 110.

Figure 2:
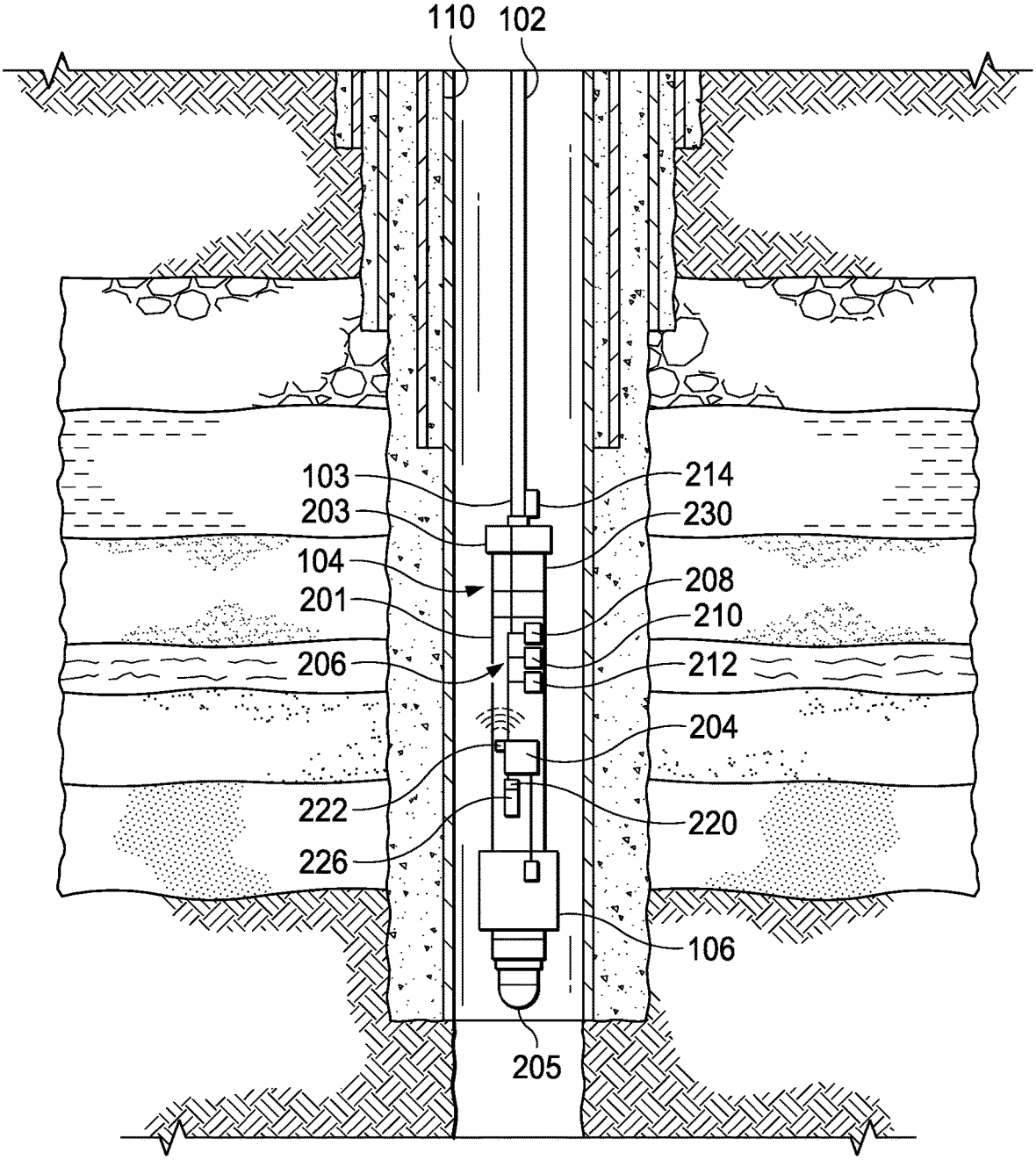
FIG. 2 is a front schematic view, partially cross sectional, of a logging tool suspended on a cable.

Referring now to FIG. 2, the wellbore tool 104 includes a housing 201 (e.g., a tubular housing) that has a first end 203 and a second end 205 opposite the first end 203. The first end 203 is attached to the downhole end 103 of the cable 102.

The wellbore tool 104 also includes one or more sensors 206 electrically attached to a controller 204. All or some of the sensors 206 can reside inside the housing 201. The sensors 206 detect one or more parameters of the wellbore tool 104 or the cable 102 or both. For example, the sensors 206 can detect an acceleration of the wellbore tool 104, an angular velocity of the wellbore tool 104, a tilt or inclination angle of the wellbore tool 104, a tension of the cable 102, or a combination of them. The sensors 206 can include an accelerometer 208, a gyroscope 210, a tilt sensor 212, and a tension sensor 214. The accelerometer 208 detects or senses an acceleration of the wellbore tool 104. The gyroscope 210 detects an angular velocity of the wellbore tool 104. The tilt senor 212 detects an angle of inclination of the wellbore tool 104. The tension senor 214 is attached to the cable 102 at or near the downhole end 103 of the cable 102 and it detects the tension of the cable 102.

The controller 204 can be or include a processor such as a computer processor and a controller unit communicatively coupled to the processor. The controller 204 is configured to receive and process information from the sensors 206 to then control or activate the packer 106. The controller 204 can be communicatively coupled to a memory 220 or storage device that stores information from the controller 204. For example, the memory 220 can store logging data (e.g., formation information and other wellbore data) gathered by the logging tool. The memory 220 can also store location information received from the controller 204.

The wellbore tool 104 also includes a transmitter 222 that can send location information to the surface of the wellbore 100. As further described in detail below with respect to FIG. 3, the transmitter 222 can send information to an operator at the surface of the wellbore to help determine the exact location of the wellbore tool 104.

The wellbore tool 104 includes one or more batteries 226 (e.g., lithium-ion batteries) that power at least one of the controller 204, the transmitter 222, or the sensors 206.

Figure 3:
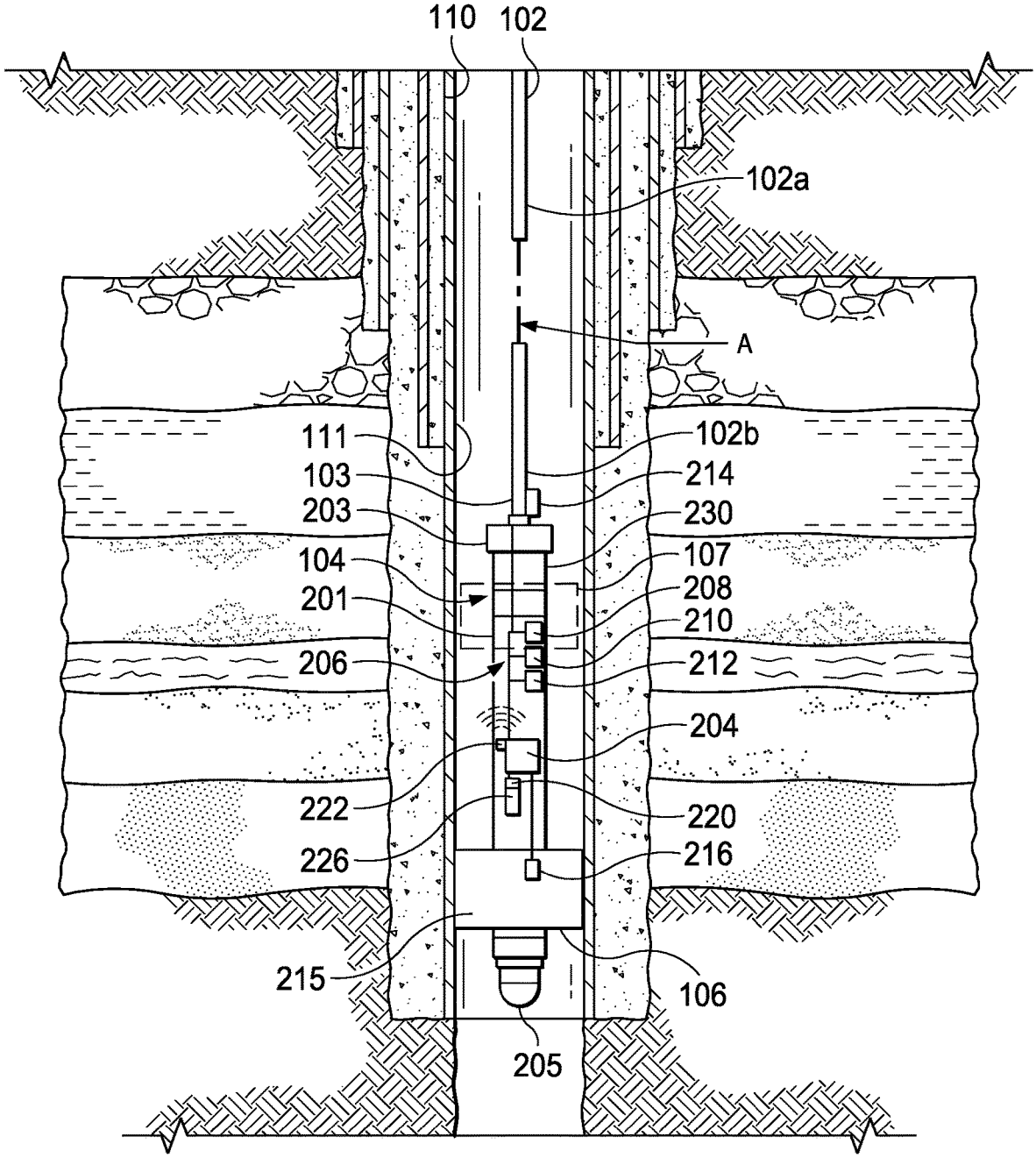
FIG. 3 is a front schematic view, partially cross sectional, of the logging tool in FIG. 2, parted from the cable.

FIG. 3 shows the wellbore tool 104 separated from the cable 102 and set on a wall 111 of the wellbore 110. Once the tool 104 is separated from the cable 102, the tool 104 is falling (e.g., in free-fall) and begins accelerating toward the downhole end of the wellbore 110. To stop the tool 104 from further falling, the controller 204 activates the packer 106 to secure or anchor the tool 104 to the wall 111 of the wellbore 110.

The packer 106 can include an inflatable or expandable rubber element 215. The rubber element 215 extends or expands radially from the housing 201 of the tool 104 to the wall 111 of the wellbore 110. The packer 106 is an electrically activable packer. For example, the controller 204 sends a signal to the packer 106 to activate a packer's onboard electronics module. The controller 204 can process sensor information and actuate the packer in real time. By "real time," it is meant that a duration between receiving an input and processing the input to provide an output can be minimal, for example, in the order of seconds, milliseconds, microseconds, or nanoseconds, sufficiently fast to avoid the tool 104 from falling a substantial distance from the point of failure.

The controller 204 determines, with the wellbore tool 104 parted from the cable 102, that the wellbore tool 104 is in free fall and then activates the packer 106. For example, the controller 204 determines, based on processing information received from one or multiple sensors 206, that the wellbore tool is in free fall. For instance, the controller 204 can compare the acceleration of the wellbore tool 104 to an acceleration threshold. The acceleration threshold can be determined based on the shape and other parameters of the tool and the wellbore. If the acceleration of the wellbore tool 104 satisfies (e.g., reaches or exceeds) the acceleration threshold, the controller 204 activates the packer 106. In some implementations, the controller can activate the packer 106 after multiple acceleration thresholds have been satisfied or after other parameter thresholds have been satisfied. For example, the controller 204 can activate the packer 1106 after determining that one or more acceleration thresholds have been satisfied and after determining that the tension of the cable 102 is zero. The tension sensor 214 can send the tension values to the controller 204. If the tension in the cable is not zero, the controller 204 can rely on the information received from the gyroscope 210 or the tilt sensor 212 to determine if the tool 104 is falling. If a false activation is detected, the tool 104 can unset the packer 106 to continue with the operation.

The packer 106 can have a length 1' that is greater than about 15% of a length of the wellbore tool 104. An adequate length of the packer 106 allows the packer to substantially center, with the packer 106 set, the wellbore tool 104 with respect to a central longitudinal axis 'A' of the wellbore 110. The dimensions and characteristics of the packer 106 can depend on the dimension and characteristics (e.g., length, width, and weight) of the wellbore tool 104. In some implementations, the wellbore tool 104 can include a second packer 107 or more than two packers. For example, the weight or length of the tool 104 can require more than one packer 106 to secure the wellbore tool 104 to the wellbore and to center the wellbore tool 104 along the wellbore 110.

The packer 106 can include one or more sensors 216 that detect and transmit, to the controller 204, packer information. The packer information can include a differential pressure (i.e., a difference between a pressure uphole of the packer and a pressure downhole of the packer), and mechanical properties (e.g., strain and stress) of the rubber element. The controller 204 determines, based on the packer information, at least one of a condition of the packer 106 and a seal integrity of the packer 106.

The transmitter 222 sends location information to the surface of the wellbore 100. For example, the controller 204 determines, based on the acceleration data of the accelerometer 208, a distance traveled by the wellbore tool 104 from the location of separation, where the tool 104 separates from the cable 102, to the location of engagement, where the tool 104 is set on the wellbore 110. The transmitter 222 sends such information to a receiver at or near the surface of the wellbore 110. An operator (or a computer) can use the travel distance information to determine the location of the tool 104. For example, an operator at the surface can pull out the cable 102 from the wellbore and measure or record the length of the cable to determine a length of a first cable portion 102*a* (e.g., a length of the cable uphole of the point of failure). The operator can subtract the length of the first cable portion 102*a* from the total length of the cable 102 to determine a length of a second cable portion 102*b* (e.g., a length of the cable downhole of the point of failure). The operator can then add the length of the first cable portion 102*a* to the length of the second cable portion 102*b* and to the distance traveled to determine the location of the tool 104.

Figure 4:
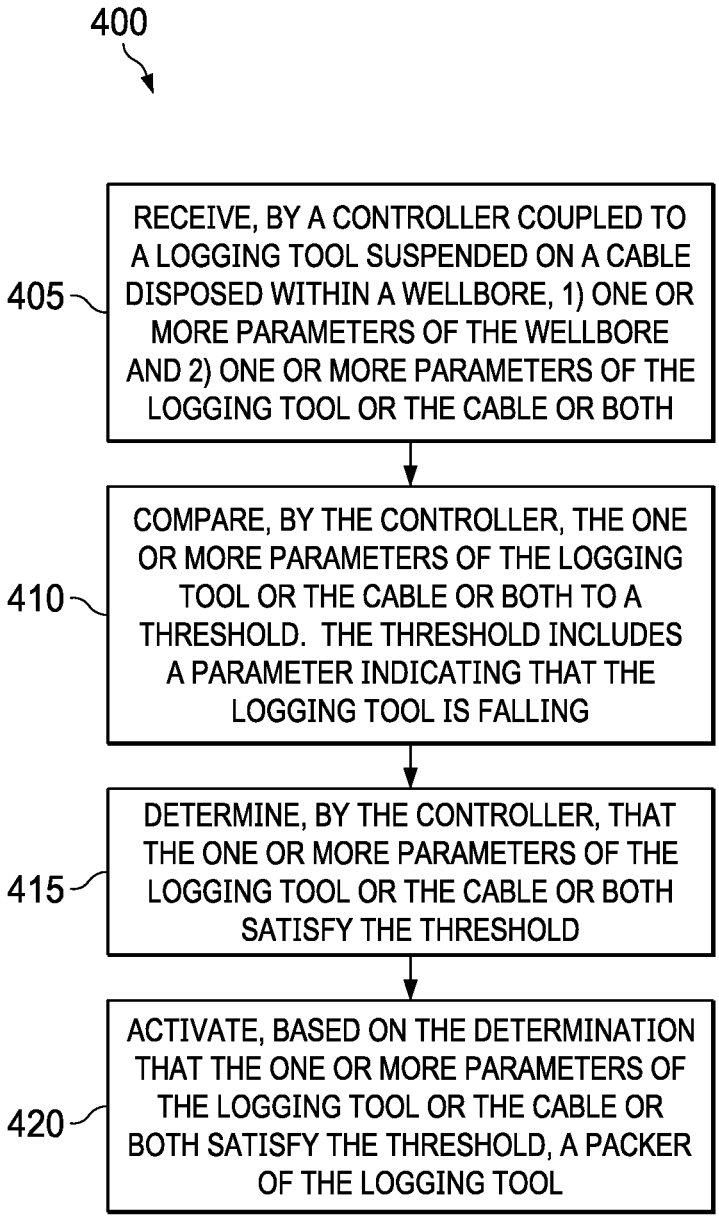
FIG. 4 is a flow chart of an example method of wellbore logging.

FIG. 4 shows a flow chart of a method 400 of wellbore logging. The method includes receiving, by a controller coupled to a logging tool suspended on a cable disposed within a wellbore, 1) one or more parameters of the wellbore and 2) one or more parameters of the logging tool or the cable or both (405). The method also includes comparing, by the controller, the one or more parameters of the logging tool or the cable or both to a threshold. The threshold includes a parameter indicating that the logging tool is falling (410). The method also includes determining, by the controller, that the one or more parameters of the logging tool or the cable or both satisfy the threshold (415). The method also includes activating, based on the determination that the one or more parameters of the logging tool or the cable or both satisfy the threshold, a packer of the logging tool. The activated packer secures the logging tool to a wall of the wellbore (420).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A wellbore assembly comprising:

a cable disposed within a wellbore and extending from or near a surface of the wellbore to a downhole end of the cable; and a wellbore tool coupled to the downhole end of the cable and suspended on the cable, the wellbore tool comprising:

a housing coupled to the cable, one or more sensors coupled to the housing or the cable or both and responsive to one or more parameters of the wellbore tool or the cable or both, the one or more parameters comprising at least one of an acceleration of the wellbore tool, an angular velocity of the wellbore tool, a tilt angle of the wellbore tool, or a tension of the cable;

a packer; and a controller coupled to the housing, the controller electrically coupled to the one or more sensors and operationally coupled to the packer, the controller configured to determine, with the wellbore tool separated from a first portion of the cable and based on feedback received from the one or more sensors, an indication of the wellbore tool in free fall, the controller configured to activate, based on the determination, the packer to expand the packer and set the wellbore tool on a wall of the wellbore;

wherein the controller is configured to determine, based on the sensor feedback, that the tension of a second portion of the cable attached to the wellbore tool is zero, and the controller is configured to activate the packer based on the determination that the tension is zero.

2. The wellbore assembly of claim 1, wherein the one or more sensors comprises at least one of an accelerometer coupled to the housing and configured to detect an acceleration of the wellbore tool, a gyroscope coupled to the housing and configured to detect an angular velocity of the wellbore tool, a tilt senor coupled to the housing and configured to detect an angle of inclination of the wellbore tool, or a tension senor coupled to the cable adjacent the wellbore tool and configured to detect a tension of the cable.

3. The wellbore assembly of claim 1, wherein the controller is configured to compare the one or more parameters to respective thresholds and activate, based on a determination that the or more parameters satisfy the respective thresholds, the packer.

4. The wellbore assembly of claim 1, wherein the controller is configured to compare the acceleration of the wellbore tool to an acceleration threshold and determine, based on the comparison, that the acceleration of the wellbore tool satisfies the acceleration threshold, the controller configured to activate, based on the determination that the acceleration of the wellbore tool satisfies the acceleration threshold and based on a determination that the tension of the cable is zero, the packer.

5. The wellbore assembly of claim 1, wherein the wellbore tool further comprises a transmitter coupled to the housing and communicatively coupled to the controller, the transmitter configured to receive from the controller and transmit, to a receiver at or near a surface of the wellbore, location information of the wellbore tool.

6. The wellbore assembly of claim 1, where the packer comprises a length that is greater than 15% of a length of the wellbore tool such that the packer substantially centers the wellbore tool with respect to a central longitudinal axis of the wellbore.

7. The wellbore assembly of claim 6, wherein the one or more sensors are configured to detect and transmit, to the controller, packer information, and the controller is configured to determine, based on the packer information, at least one of a condition of the packer and a seal integrity of the packer.

8. The wellbore assembly of claim 1, wherein the packer comprises an electrically-activable packer, the electrically-activable packer comprising an inflatable rubber element configured to extend, upon activation by the controller, radially from the wellbore tool to a wall of the wellbore.

9. The wellbore assembly of claim 1, wherein the wellbore tool comprises a logging tool, the logging tool comprising one or more batteries configured to power at least one of the controller or the one or more sensors.

10. The wellbore assembly of claim 9, wherein the wellbore tool further comprises a memory coupled to the housing and communicatively coupled to the controller, the memory configured to store logging data.

11. A wellbore tool comprising:

a housing configured to be coupled to a cable configured to be disposed within a wellbore;

one or more sensors coupled to the housing or the cable or both and configured to detect one or more parameters of the wellbore tool or the cable or both;

an anchor assembly; and a controller coupled to the housing, the controller electrically coupled to the one or more sensors and operationally coupled to the anchor assembly, the controller configured to determine, based on feedback received from the one or more sensors, that the tension of a portion of the cable attached to the housing is zero and thereby the tool is falling, the controller configured to activate, based on the determination, the anchor assembly to anchor the wellbore tool on a wall of the wellbore.

12. The wellbore tool of claim 11, wherein the controller is configured to determine in or near real time the indication of the wellbore tool in free fall and activate the anchor assembly.

13. The wellbore tool of claim 11, wherein the controller is configured to compare two parameters of the wellbore tool to two respective thresholds and activate the anchor assembly upon determining that both thresholds have been met.

14. The wellbore tool of claim 11, wherein the one or more parameters comprises an acceleration of the wellbore tool, and the controller is configured to activate the anchor assembly upon determining that the acceleration of the wellbore tool is equal to or greater than an acceleration threshold that indicates that the wellbore tool is in free fall when parted from the cable.

15. A method comprising:

receiving, by a controller coupled to a logging tool separated from a cable disposed within a wellbore, sensor feedback indicating at least one of 1) one or more parameters of the wellbore or 2) one or more parameters of the logging tool or the cable or both, the one or more parameters of the logging tool or the cable or both comprising a tension of a portion of the cable attached to the logging tool;

comparing, by the controller, the one or more parameters of the logging tool or the cable or both to a threshold, the threshold comprising a parameter indicating that the logging tool is in free fall;

determining, by the controller, that the one or more parameters of the logging tool or the cable or both satisfy the threshold; and activating, based on the determination that the one or more parameters of the logging tool or the cable or both satisfy the threshold, a packer of the logging tool, the activated packer configured to secure the logging tool to a wall of the wellbore;

wherein determining that the one or more parameters of the logging tool or the cable or both satisfy the threshold comprises determining that the tension of the portion of the cable is zero.

16. The method of claim 15, further comprising transmitting, by the controller and to a transmitter of the logging tool, location information of the logging tool, the transmitter configured to wirelessly transmit the location information to a receiver at or near a surface of the wellbore.

17. The method of claim 15, wherein the one or more parameters of the logging tool or the cable or both comprises an acceleration of the logging tool and comparing the one or more parameters of the logging tool or the cable or both comprises comparing the acceleration of the wellbore tool to an acceleration threshold indicating that the logging tool is in free fall.

* * * * *